US006769884B2

(12) United States Patent
Miller

(10) Patent No.: US 6,769,884 B2
(45) Date of Patent: Aug. 3, 2004

(54) HYDRAULIC DRIVE SYSTEM FOR PISTON PUMPS

(76) Inventor: Cory L. Miller, Rte. 8, Box 84555, Winnsboro, TX (US) 75494

( * ) Notice: Subject to any disclaimer, the term of this patent is extended or adjusted under 35 U.S.C. 154(b) by 0 days.

(21) Appl. No.: 10/014,729

(22) Filed: Dec. 10, 2001

(65) Prior Publication Data

US 2002/0071771 A1 Jun. 13, 2002

Related U.S. Application Data

(60) Provisional application No. 60/254,808, filed on Dec. 11, 2000.

(51) Int. Cl.[7] ..... F04B 17/00

(52) U.S. Cl. ..... 417/404; 417/401; 91/313; 91/275; 91/304

(58) Field of Search ..... 91/313, 304, 275; 417/404, 401, 399

(56) References Cited

U.S. PATENT DOCUMENTS 3,700,360 A * 10/1972 Shaddock ..... 417/404
4,946,352 A 8/1990 Evenson ..... 417/396
4,949,623 A * 8/1990 Schulze ..... 91/313
4,990,058 A * 2/1991 Eslinger ..... 417/46
5,120,202 A * 6/1992 Murata et al. ..... 417/401
5,173,036 A * 12/1992 Fladby ..... 417/403
5,505,593 A 4/1996 Hartley ..... 417/393
5,564,912 A 10/1996 Peck et al. ..... 417/396
5,944,045 A * 8/1999 Allen et al. ..... 417/401
6,454,542 B1 * 9/2002 Back ..... 91/275

* cited by examiner

*Primary Examiner*—Cheryl J. Tyler
(74) *Attorney, Agent, or Firm*—C. W. Alworth

(57) ABSTRACT

A hydraulic drive system is provided to produce a smoothed or near sinusoidal output flow characteristic for reciprocating piston pumps. The device occupies a smaller footprint than conventional mechanical reciprocating pumps and allows a standard reciprocating pump to operate at its maximum rated pressure while retaining its maximum rated flow. Several embodiments are disclosed and the drive system may be coupled to standard duplex and triplex pumps. A solution to hydraulic hammer caused by rapid flow reversal in the hydraulic control valves used within the system is presented.

13 Claims, 15 Drawing Sheets

PRIOR ART

PRIOR ART

HYDRAULIC DRIVE SYSTEM FOR PISTON PUMPS

This application claims priority from U.S. Provisional Patent Application Serial No. 60/254,808 filed on Dec. 11, 2000.

The present invention relates generally to drive systems for positive displacement pumps and in particular to a hydraulic drive mechanism for piston pumps.

BACKGROUND OF THE INVENTION

Reciprocating positive displacement piston pumps have been the standard means of pumping drilling fluids and slurries in the oilfield, the water well drilling industry, the food industry, and in many other applications where high pressures are required and/or highly viscous fluids or heavy slurries are pumped, or where constant or controlled volumes are needed. These mechanically driven reciprocating pumps are dependable but possess a number of limitations and undesirable characteristics. The hydraulically driven piston pumps currently available also possess their own unique limitations and undesirable characteristics.

Mechanically driven reciprocating positive displacement piston pumps that are double acting (that is, they pump in both directions as the piston moves in and out of the pump cylinder) have a rod connected to the piston that forces it fore and aft in the cylinder. The fact that there is a rod on one side of the piston and no rod on the other side creates an uneven displacement as the pumping cycle changes due to movement of the piston from one direction to the other. This causes a surging condition because the flow rate varies up and down with the reciprocation of each piston and causes undesired pressure spikes and inefficiencies in the pumping process.

Further, the mechanical systems used to drive these pumps cause an even worse surging characteristic as a result of the way that the rotating eccentrics drive the pistons back and forth. As these eccentrics rotate, the piston starts with no motion at the end of one stroke through a relatively slow acceleration in travel speed to a relatively high travel speed at the center of the stoke. The piston then decelerates slowing to a movement of no motion at the end of the stroke before it begins motion in the other direction. As a result of these two contributing factors, there are strong surges and pressure spikes in the flow rates of mechanically driven reciprocating positive displacement double acting piston pumps.

The commercially available mechanical pumps described above typically have varying pressure ratings and/or flow ratings depending on the cylinder and piston diameter that is installed in the pump. For example, a given pump equipped with a 6-inch diameter piston/cylinder combination will pump at 300 gpm giving a 250-psi discharge pressure. To reach 1000 psi a 3-inch diameter piston/cylinder combination must be used that results in a flow rate of only 75 gpm. This is because the mechanical drive units are not strong enough to drive 6-inch piston/cylinder combinations at 1000 psi even though the pump chamber is capable of both the high flow rate (300 GPM) and the high pressure (100 PSI).

Mechanically driven piston pumps are very heavy because of the large cast iron housings and gears necessary for them to operate. This excessive weight limits the use of these mechanically driven pumps to unsatisfactory capacities. The designers of such equipment must either compromise other parts of the machine in order to place enough pumping capacity within the machine or compromise pumping capacity to allow for the weight of the components within the machine.

Currently available hydraulically driven mud pumps typically have one hydraulic drive cylinder in the center of the unit connected by its rods to a pump chamber on each end. This stops the surging problems of mechanical pumps, but makes for a relatively long assembly because of the fact that there are pump chambers on both ends as opposed to only a single pump cylinder on one end of the mechanical drive unit.

Hydraulic cylinder driven pumps that have pump chambers only on one end of the drive cylinder suffer the same surge problems of mechanical pumps or worse because of the unmatched displacement ratios between the pump chambers and the hydraulic cylinders. This is due to the fact that the displacement ratios caused by the rod(s) in the hydraulic cylinders and the rod in the one side of the pump chambers are not engineered to compensate for each other.

The inventor knows of no art that attempts to resolve the "uneven displacement" problem. There is considerable art in the field of pumps that utilize hydraulic drives for pumps. Evenson (U.S. Pat. No. 4,946,352) discloses a Dual Action Piston Pump. The Evenson system places a hydraulic cylinder at either end of a duplex (two volumetric outputs per complete pump stroke) pump cylinder. Evenson is mostly concerned with a "valving" arrangement that synchronizes the strokes of the hydraulic cylinders with the pump piston and directs the hydraulic fluid and pump inlet and outlet flows.

Hartley et al. (U.S. Pat. No. 5,505,593) disclose a Reciprocable (sic) Device with Switching Mechanism. Again Hartley is concerned with the synchronizing valve for moving the pump with hydraulic (or other) power. Close examination of the drawings shows that the one of the pump and/or power regions suffers from "uneven displacement."

Peck et al. (U.S. Pat. No. 5,564,912) disclose a Water Driven Pump. Peck is concerned with using a primary fluid pressure source to deliver secondary fluid under pressure. Again close examination of the drawings shows that that the one of the pumps and/or power regions suffers from "uneven displacement."

Thus, there remains a need for an improved hydraulic pump drive system that can provide maximum horsepower over the entire range of the pump; that will provide constant displacement volume with each stroke of the pump, regardless of direction of stroke; that will result in a smaller power unit when compared to standard mechanical units; and that will result in a shorter (and smaller) unit when compared to present state of the art hydraulic drive units.

SUMMARY OF THE INVENTION

The instant invention consists of a single hydraulic piston connected to a double acting pump chamber. The hydraulic power cylinder has rods extending from each end of the cylinder both of which are connected to the hydraulic piston within the cylinder. One end is connected to the pump piston (via a connecting rod on the pump) and the other end extends in the opposite direction.

When hydraulic pressure is exerted against the hydraulic piston on the side nearest the pump, the pump piston moves towards the hydraulic cylinder. This action displaces whatever fluid the pump is pumping out of the pump into the pump manifold through a check valve in the normal manner. When hydraulic pressure is exerted against the hydraulic piston on the side furthest from the pump, the pump piston moves away from the hydraulic cylinder. This action displaces whatever fluid the pump is pumping out of the pump into the pump manifold through a check valve in the normal manner.

As stated earlier, the pump stroke away from the hydraulic cylinder will displace more fluid because there is no pump rod within the cylinder. On the other hand, the pump stroke towards the hydraulic cylinder will displace less fluid because the pump rod occupies a given volume within the pump cylinder.

To counter this effect, the diameters of the two rods extending from the hydraulic cylinder are sized so that the ratios of the displacements are matched. This causes even flow of fluid from the pump on each stroke (in or out).

The ends of the hydraulic cylinders that are NOT connected to the pump are used to control hydraulic fluid movement or direction and therefore control the reciprocating movement of the hydraulic drive. The hydraulic valve controls where the hydraulic fluid pressure is applied—that is, to one or the other side of the hydraulic piston.

The instant invention uses three different methods to control the hydraulic fluid movement or direction. The preferred method uses a hydraulic pilot valve that controls a hydraulic slave valve. The pilot valve is controlled by a simple mechanical link between the hydraulic power cylinder and the pilot valve. The movement of the hydraulic cylinder switches the direction of hydraulic fluid through the pilot valve that in turn switches the direction of applied hydraulic fluid to the hydraulic cylinder resulting in reciprocation of the piston within the hydraulic cylinder as long as hydraulic energy (power) is applied.

An alternate embodiment uses a mechanical switching means that is connected to the hydraulic rod opposite to the pump. As the hydraulic piston moves away from the pump and reaches the maximum point, it trips a mechanical limit that positions the control valve to apply hydraulic fluid to the other side of the cylinder. In a similar manner, as the hydraulic piston moves away from the pump and reaches the maximum point, it trips another mechanical limit that positions the control valve to apply hydraulic fluid to the first side of the cylinder. Thus, the hydraulic drive system will reciprocate as long as hydraulic power is supplied to the unit.

A further alternate embodiment uses a proximity switch, instead of mechanical limits, to control a solid-state relay that controls the application of hydraulic power to the cylinder via an electric solenoid valve. Therefore, in a like manner, the hydraulic drive system will reciprocate as long as hydraulic power is supplied to the unit.

DETAILED DESCRIPTION OF THE EMBODIMENT

Figure 1:
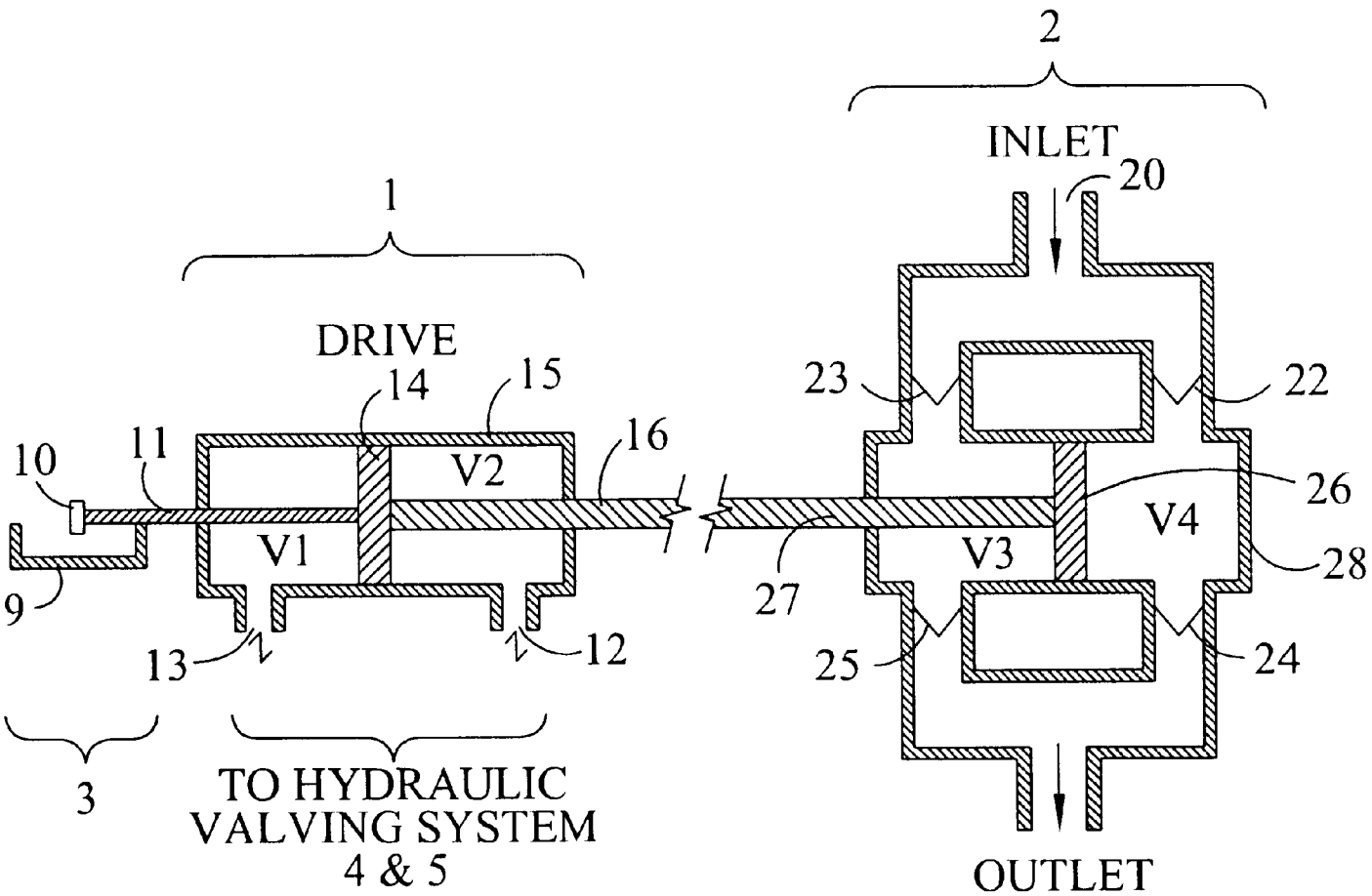
FIG. 1 is a conceptual view of the instant device showing the hydraulic drive cylinder joined to a pump—note regions V1/V3 and V2/V4.

Refer to FIG. 1; the instant invention consists of a hydraulic cylinder, 1, connected to a pump chamber, 2, by way of series of (piston) rods, 16 and 27. The hydraulic cylinder, 1, has piston rods, 16 (drive rod) and 11 (control rod), coming out of both ends of the hydraulic power cylinder. Each (piston) rod is attached to the hydraulic piston, 14. Each of the hydraulic (piston) rods, 16 and 11, have different diameters so that the ratio of the different displacements (volumes) between one end and the other end of the hydraulic cylinder matches the ratio of the different displacements between the end of the pump chamber, V3, that has a pump piston rod, 27, and the end of the pump chamber, V4, that has no piston rod.

In the preferred embodiment the fluid pump, generally item 2, is an industry standard pump. The standard industry pump consists of an outer housing, 28, (generally cast iron—although any material could be used) with a piston, 26, operating within a sleeve (not illustrated for reasons of clarity). The piston is connected to a piston rod, 27, that exits the pump chamber through necessary seals (not illustrated for reasons of clarity). Associated with the pump chamber are an inlet and inlet manifold, 20, and associated check valves, 23 and 22. These valves and the inlet manifold direct the pumped fluid to one of the two pump chambers V3 and V4.

In a similar manner, the two pump chambers, V3 and V4, are associated with an outlet and outlet manifold, 21, and associated check valves, 25 and 24. (For ease of understanding odd and even numbers are related when discussing the displacement or volumes associated with the pump and the hydraulic cylinder.) The invention does not claim the pump; therefore, the discussion relating to the pump itself will be brief; however, some understanding of the standard industry reciprocating pump is required in order to understand the invention.

Figure 10A:
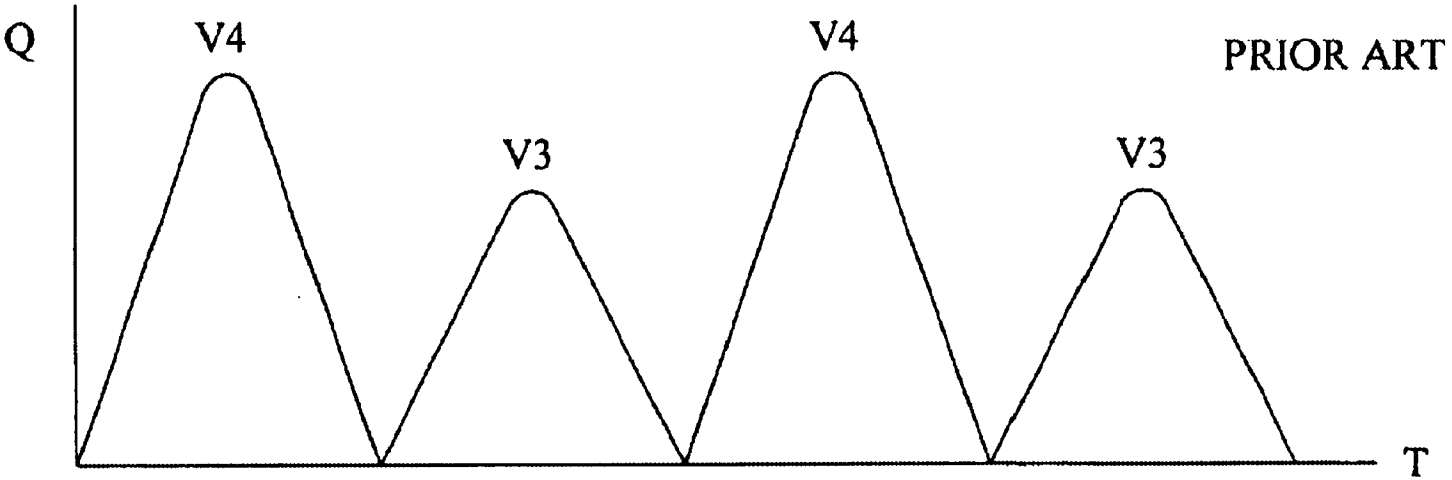
FIG. 10A illustrates the uneven flow characteristic of a standard reciprocating pump that does not employ the concept of the invention.

Refer again to FIG. 1, and assume that the piston, 26, is fully to the left hand side of the pump. Moving the pump cylinder towards the right, forces fluid in chamber V4 through check valve 24 and out of the outlet, 21. As the pump moves towards the right, fluid is drawn into chamber V3 through check valve 23 from inlet 20. Assume that the piston moves fully towards the right and the travel is now reversed (reciprocated) and the piston moves towards the left. The fluid in chamber V3 is forced through check valve 25 through the manifold and out of outlet 21. At the same time fluid is drawn into chamber V4 through check valve 22 from inlet 20. The process would then reverse itself (reciprocate). It should be very apparent that volumes associated with chambers V3 and V4 are different. In fact, V4 is greater than V3. This means that the output of the piston pump waivers (varies) over a cycle and therefore does not produce a constant volume (or displacement) to the load. I.e., the flow of fluid from a standard industry reciprocating pump varies as illustrated in FIG. 10A.

Figure 10B:
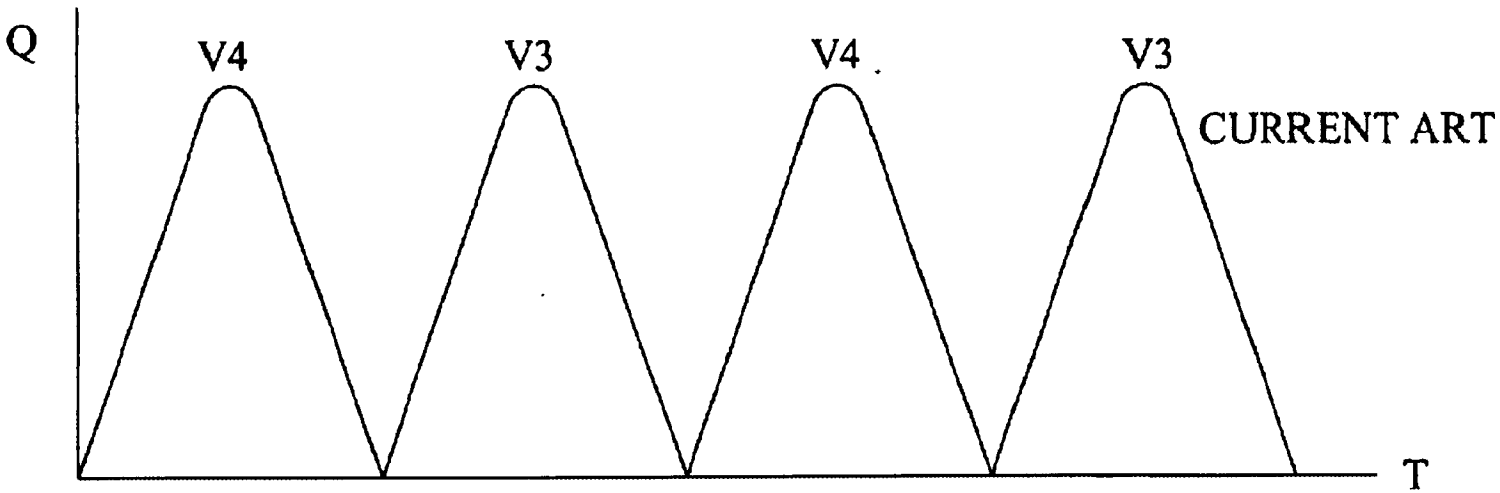
FIG. 10B illustrates the even flow characteristic of a standard reciprocating pump employing the concept of the invention.

The inventor realized that if the displacements (volumes) of each side of the pump piston could be made equal, then the flow characteristics of the pump would show great improvement and look somewhat like FIG. 10B. It can be seen that matching of the ratio of displacement between the driving chamber to the ratio of displacement of the pump chamber produces a very even sinusoidal flow rate from the pump as the piston reciprocates within the cylinders.

Referring again to FIG. 1, the hydraulic piston, 14, (within the hydraulic cylinder, 15) travels fore and aft, and the drive rod, 16, on the drive end of the hydraulic piston is connected to the piston rod, 27, that goes into the pump cylinder. (It must be remembered that in a commercially produced device the pump rod, 27 and the hydraulic piston rod, 16, may be combined.) As already explained, the piston rod connects to the pump piston driving it back and forth and moving fluid through suction and discharge check valves; thus, pumping the fluid within the pump.

The control rod, 11, on the other end of the hydraulic cylinder serves two purposes. First and primarily, the rod, 11, causes different traveling speeds of the hydraulic piston from one direction to the other direction. The difference in traveling speed results from a different diameter rod on one end of the hydraulic cylinder piston as opposed to the other end creating a different displacement per inch within each end of the cylinder.

These different hydraulic speeds compensate for the different displacement per inch of travel within the pump cylinder. The different speed is necessary due to the fact that the pump has a piston rod only on one side of the pump piston and no rod on the other side. Matching the displacement ratios causes smooth even flow in either pumping direction.

The other purpose that the control rod, 11, serves is actuation of a valve switching mechanism (system) that changes the direction of travel on the hydraulic cylinder in constant reciprocation as long as hydraulic oil is fed to the unit. The switching is accomplished in three different ways for three different embodiments, as will be explained.

In all embodiments, hydraulic oil is supplied from a standard hydraulic pump and delivered to a reciprocating control valve system. The reciprocating control valve system applies hydraulic pressure to one side or the other side of the hydraulic piston within the hydraulic cylinder. There are three embodiments for the reciprocating control valve system.

Figure 2:
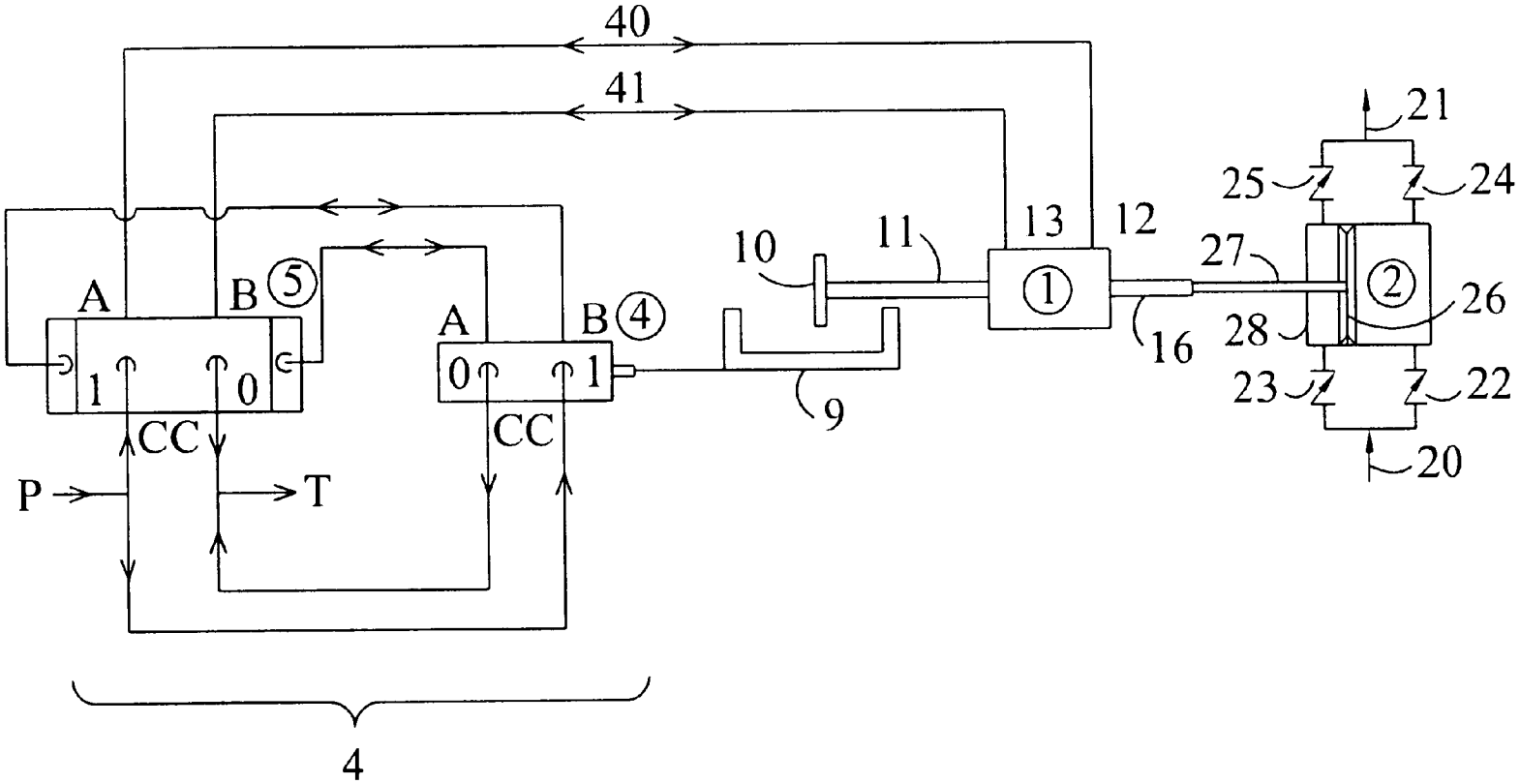
FIG. 2 is a schematic representation of the instant device using pilot/slave hydraulic valves.
Figure 3:
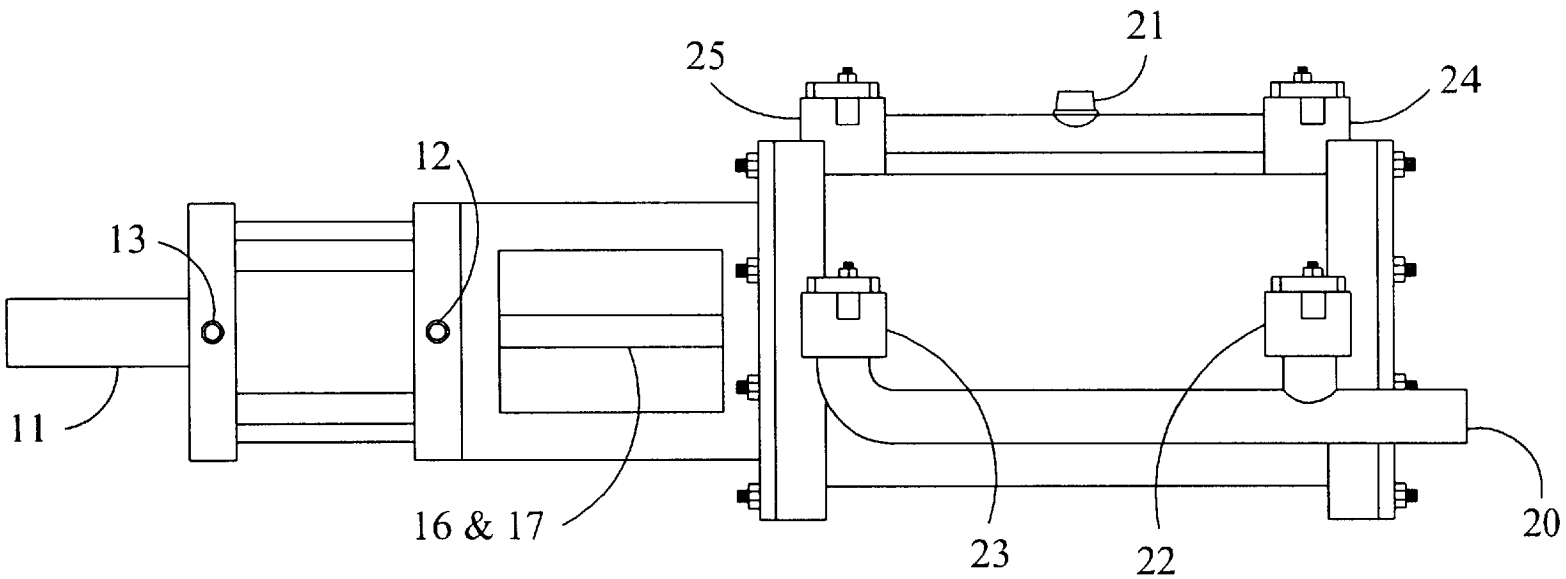
FIG. 3 is an isometric cutaway of the instant device.
Figure 4:
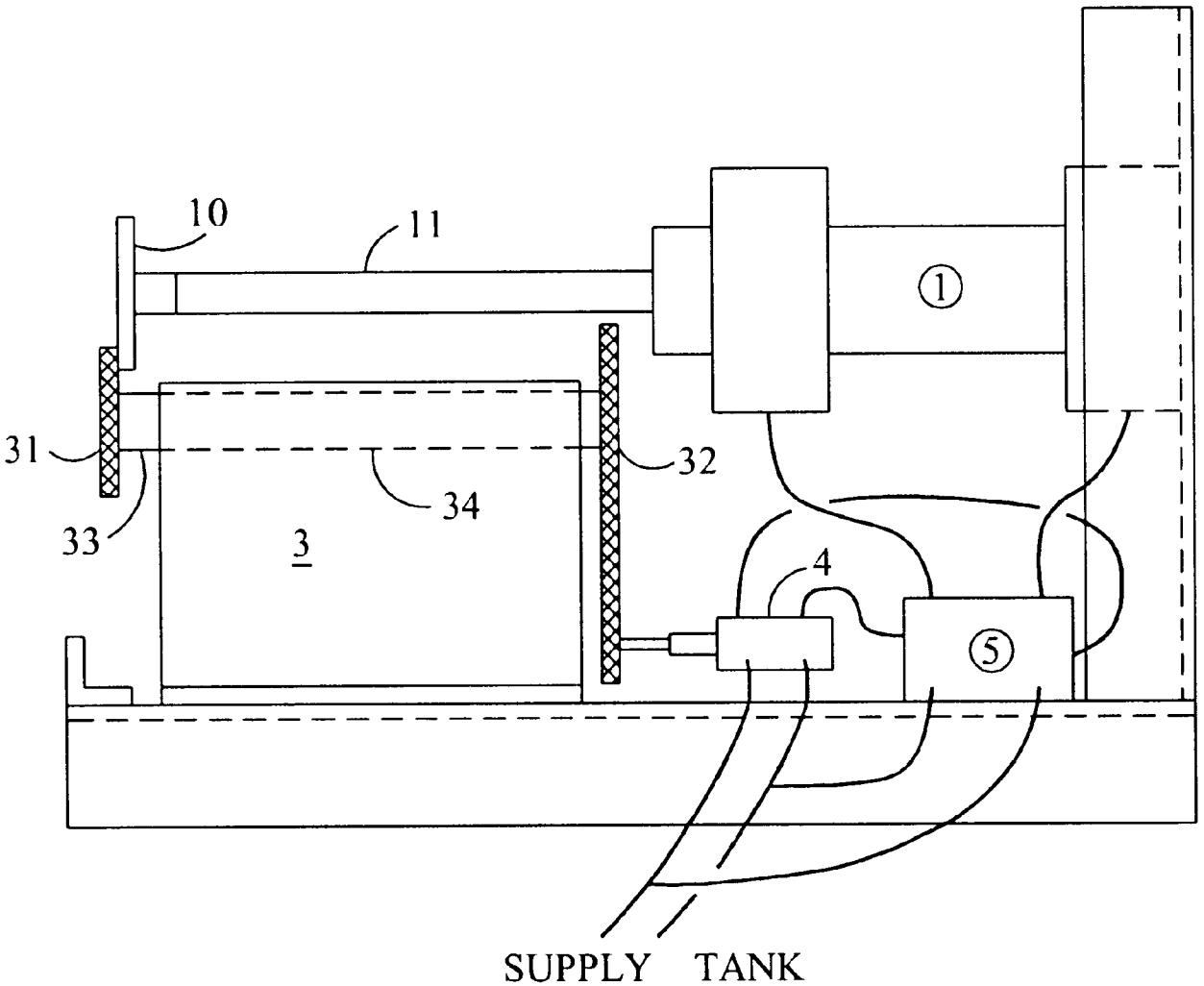
FIG. 4 shows a recommended mechanical arrangement for interaction between the hydraulic cylinder and the pilot valve.

The preferred embodiment is shown in FIGS. 2 and 4. An alternate embodiment takes the form of a pure mechanical valve that utilizes detent switches, and another alternate embodiment takes the form of an electromechanical valve that utilizes electromagnetic solenoids. The preferred embodiment, including a simple alternate, will now be described.

The control rod of the hydraulic cylinder, 11, terminates in a control disk, 10, that operates within a mechanical slider, 9. The slider mechanism is in turn connected to a hydraulic pilot valve, 4. The slider mechanism introduces mechanical hysteresis that causes a shift in the position of the pilot valve only when the control rod is at one or the other extreme position of its travel. That is, the pilot valve will shift when the control rod is fully to the left (extended) or fully to the right (retracted) of its travel.

FIG. 4 shows the mechanical layout of the hydraulic end of the current device. The mechanical slider, (shown as item 9 in FIGS. 1 and 2) takes an alternate form. The control disk, 10, may push against structure 31 that is in turn connected to slider rod 33. The slider rod is capable of movement within an aperture, 34, located in the slider block, 3. The slider rod is in turn connected to another structure 32 that is connected to the control arm (or rod) of a standard hydraulic pilot valve, 4. The control disk, 10, may also push against structure 32. This convoluted mechanical slider valve is used in order to reduce the overall dimension of the device. Thus, the control disk 10 moves between structures 31 and 32 in turn shifting the pilot valve, 4, when required, and is the mechanical equivalent of the slider mechanism shown in FIG. 2. Any person skilled in the art of mechanical devices could readily devise a mechanism to perform the required function and the above description is given to illustrate one of many methods to connect a hydraulic cylinder to a pilot valve to accomplish a required purpose.

FIG. 4 further shows a recommended hydraulic hose and control valve arrangement. Hydraulic pressure is taken from a standard hydraulic power source (hydraulic pump) and the return fluid is sent back to the supply tank.

Returning to FIG. 2, which is a schematic representation of the device, hydraulic power is supplied to point, P, and is returned to point T (and on to the hydraulic tank). As stated the pilot, 4, is controlled by the mechanical slider, 9. Assume that the slider is in its far right position, this causes the pilot valve to direct fluid to the slave valve, 5, causing the slave valve to apply pressure to port A from port I that in turn applies pressure to line 40. Line 40 is attached to port 12 of the hydraulic cylinder; thus, hydraulic fluid under pressure enters chamber V2 pushing the hydraulic piston, 14, to the left. At the same time, the slave valve, 5, connects port B to the port O thus allowing hydraulic fluid from hydraulic chamber, V1, to flow through port 13, through line 41, through ports B/O and into the hydraulic tank.

Now allow the hydraulic piston to travel to its far left position. The pilot valve will shift; thus, shifting the position of the slave valve. The slave valve will now apply pressure to port B from port I that in turn applies pressure to line 41. Line 41 is attached to port 13 of the hydraulic cylinder; thus, hydraulic fluid under pressure enters chamber V1 pushing the hydraulic piston, 14, to the right. At the same time, the slave valve, 5, connects port A to the port O thus allowing hydraulic fluid from hydraulic chamber, V1, to flow through port 12, through line 40, through ports A/O and into the hydraulic tank. This process is repeated.

It is possible to connect the control rod directly to a master hydraulic valve without using the pilot/slave valve arrangement. However, experience shows that the use of a pilot and slave valve system results in "hydraulic position gain." That is, small changes in position result in large volumes of hydraulic fluid—necessary in this application.

As can be seen, the hydraulic piston reciprocates and drives the pump piston in a reciprocal manner. It is now necessary to understand how displacement matching is achieved.

First the net piston surface area on each side of the pump piston must be obtained. The smaller area (side with the rod) is then divided by the larger area (side without the rod) to obtain the displacement ratio between the two sides of the pump piston. This is known as the pump piston displacement ratio ("PPDR" or $\alpha$). Then a hydraulic cylinder having a hydraulic pump piston ratio ("HPPR" or $\beta$) must be selected to match the pump piston displacement ratio. That is, $\alpha$ must equal $\beta$.

An example should suffice to explain the concept. Assume a pump with a 7½ inch diameter piston having a single piston rod of 1½ inches in diameter.

Therefore knowing that:

$$A = \pi (D_p/2)^2$$

where A is area and $D_p$ is pump piston diameter then the larger area (without a piston rod) is $3.1416(7.5/2)^2$ or 44.1788 square inches.

The smaller area (with a piston rod) is obtained by subtracting the area occupied by the piston from the area occupied by the piston. That is:

$$44.1788-\{3.1416(1.5/2)^2\}=44.1788-1.7672 \text{ or } 42.4117 \text{ square inches.}$$

Thus the PPDR or $\alpha$ is 0.96 (96:100).

This mathematical calculation can be shown to reduce to:

$$\alpha=(1-d^2/D_p^2)$$

where $D_P$ is the pump piston diameter, and d is the pump rod diameter.

Now the hydraulic cylinder, piston and associated rods must be selected from an industry standard or manufacturer to produce a 96:100 ratio. At this stage some hydraulic acumen must be applied. The designer must decide what size of hydraulic rod and piston size will carry the force (pressures) required to drive the pump at the correct ratio and speed. It is best to start with the drive end of the hydraulic system.

For example, a hydraulic cylinder of 3½ inch diameter or 4-inch diameter can operate a 7½ inch piston pump and each one is commercially available. The 3½ inch diameter cylinder uses less oil than the 4-inch cylinder, but does not provide as much overall driving force. The 3½ inch standard hydraulic cylinder is available (off-the-shelf) with a 2¼ inch diameter rod at one end and a selection of fixed standard choices at the other (control) end; whereas, the 4-inch cylinder is available with a 60 mm (2.3622 inches) diameter rod also with a selection of fixed choices at the other (control) end. Unfortunately the manufacturer sets the selection of the "other rod"; therefore, some calculations and choices must be made.

By way of example, assume a 3½ hydraulic cylinder with a drive rod of 2¼ inches diameter and (lucky guess or choice) with the other rod (control rod) being 55 mm (2.165 inches) diameter. (55 mm is one of the fixed choices set by the manufacturer.) The hydraulic pump piston ratio (HPPR) $\beta$ may be found by dividing the smaller area (piston side with the drive rod) by the larger area (piston side with the control rod). Thus the smaller area is given by:

$$\pi(3.5/2)^2-\pi(2.25/2)^2=9.6211-3.9761=5.6450 \text{ square inches}$$

The larger area is given by:

$$\pi(3.5/2)^2-\pi(2.165/2)^2=9.6211-3.6813=5.9398 \text{ square inches}$$

Therefore $\beta$ is 5.6450/5.9398 =0.9504, which is very close to $\alpha$=0.96.

The formula for determining $\beta$ can be shown to be:

$$\beta=\{D_h^2-\gamma^2\}/\{D_h^2-\delta^2\}$$

where $D_h$ is hydraulic piston diameter, $\gamma$ is the larger (drive) rod diameter, and $\delta$ is the smaller (control) rod diameter.

Because $\alpha$ and $\beta$ are equal (required by matched displacement ratios), it is possible to calculate the smaller control rod diameter, $\delta$, based on a known hydraulic cylinder diameter, $D_h$, the pump piston displacement ratio $\alpha$, and fixed drive rod diameter, $\gamma$. The formula may be shown to be:

$$\delta=\{\{\gamma^2-D_h^2(1-\alpha)\})/\alpha\}^{1/2} \text{ (all units must be consistent).}$$

Using the above formula and the above example and letting the control rod diameter be a variable, the control rod diameter, for a PPDR of 96:100, becomes:

2.146 inches.

Thus, it is possible to make the hydraulic cylinder exactly match the pump.

There is a further method that can be used to match displacement ratio pump to hydraulic cylinder displacement ratio. The control rod on the hydraulic cylinder can be eliminated and the control disk moved to the junction of the drive rod, 16, and pump rod, 27. The pump rod, 27, is upsized to a larger diameter than is structurally required in order to match displacement ratios. This embodiment will allow the overall length of the pump/driver assembly to be reduced because there will not be a control rod extending from the hydraulic driver.

For example, 4½ inch hydraulic drive cylinder utilizing a 1¼ inch drive rod with NO control rod will have a displacement ratio, $\beta$, of 0.9132. Now allow the hydraulic cylinder to drive a 10-inch diameter pump. The diameter of the pump rod connected to and driven by the hydraulic cylinder must be 2.9462 inches to create the required matched displacement ratios. The engineering choice would be to use a 3-inch diameter piston rod (the next standard) in the pump, or manufacture one's own cylinder, rod and seals.

The formula for matching displacement ratios between the pump and the hydraulic cylinder without a control rod is given by:

$$\gamma=\{(d^2D_h^2)/(D_p^2)\}^{1/2}$$

where the terms have already been defined and the units must be consistent.

During development of the preferred hydraulic control system, described above, the inventor noted that an objectionable "BANG" would occur with each shift of the pilot valve and slave valve. The bang or thud was caused by hydraulic hammer within the hydraulic system. The actual sound was equivalent to the discharge of a 10-guage elephant gun and was determined to be objectionable for several reasons: one, the end user would think that the equipment was undergoing self destruction; two, the sound would objectionable under Occupational Safety and Heath (OSHA) regulations; and three, uncontrolled hydraulic hammer would eventually destroy the system.

In analyzing the noise problem, the inventor determined that the hammer was caused by the rapid reversal of the flow of high-pressure hydraulic fluid. In other words, the valves were attempting to change energy states instantaneously—a condition that the fundamental laws of physics and engineering do not allow—resulting in the hydraulic hammer.

Figure 5:
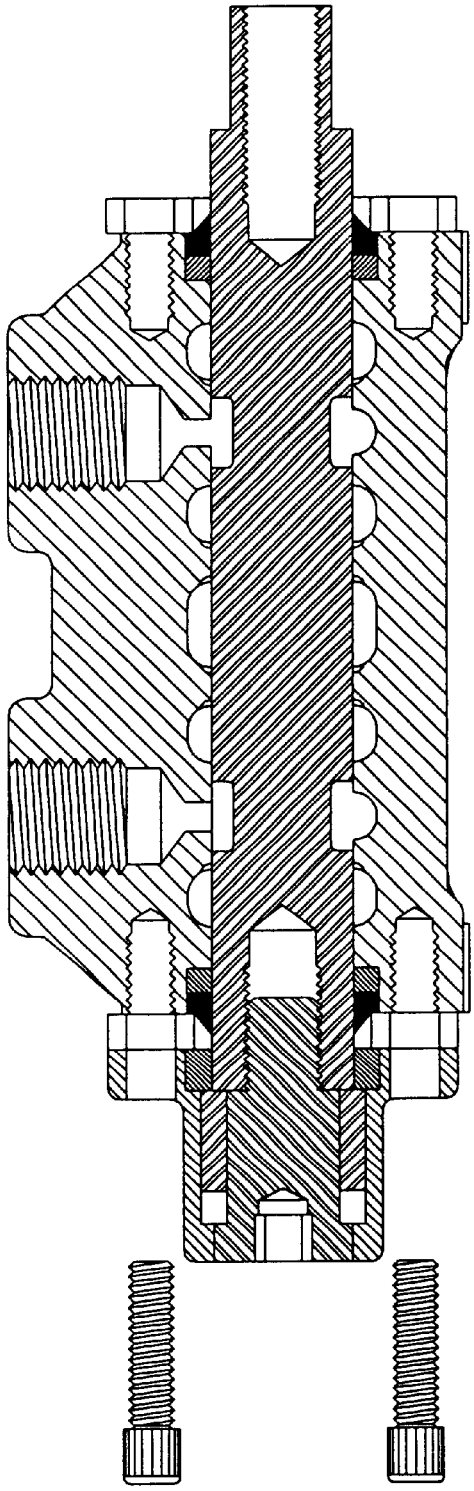
FIG. 5 is a manufacturer's cutaway drawing of a closed center hydraulic valve that is used as a pilot valve in the instant device. The spool within the valve is shown in the neutral (center) position.
Figure 6:
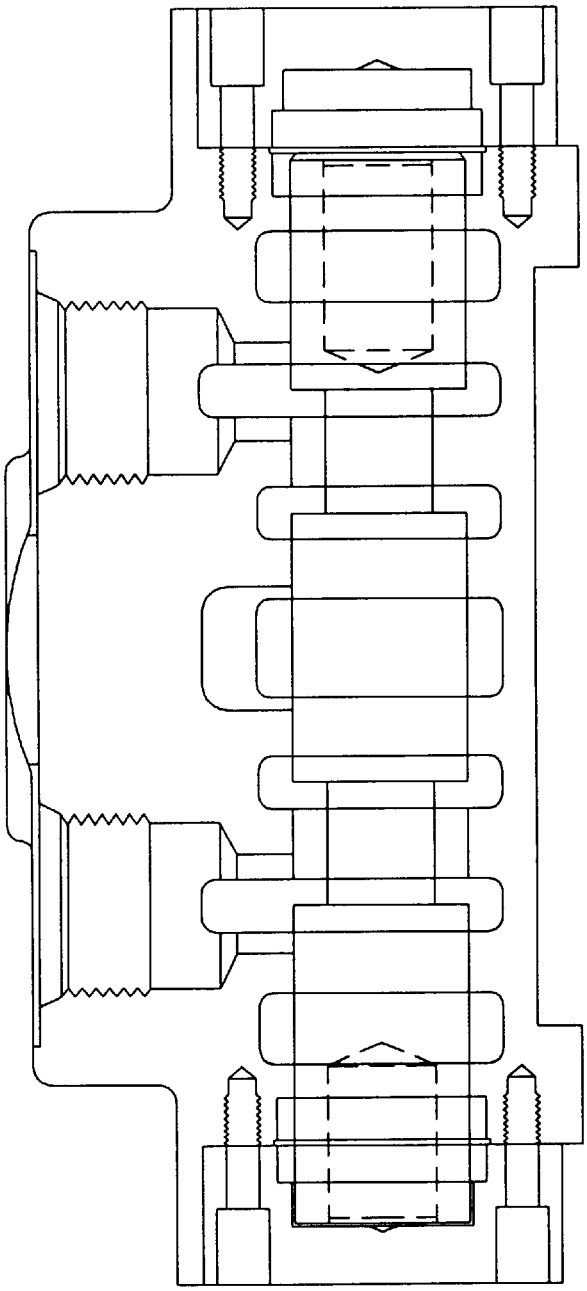
FIG. 6 is a manufacturer's cutaway drawing of a closed center hydraulic valve that is used as a slave valve in the instant device. The spool within the valve is shown in the leftmost working position.

A standard off-the-shelf pilot valve is shown in FIG. 5, and an off-the-shelf slave valve is shown in FIG. 6. Each valve includes a "spool" which moves within the valve body from the far left position to the far right position. At one position or the other, the spool connects the pressure port with one of the two switched ports and at the same time connects the discharge port with the other switched port that is not connected to the pressure port. Each of the valves shown in the figures has a mid-point position that blocks both switched ports, the pressure port and the discharge port. It is possible to obtain valves that have an "open" center position that opens the pressure port and allows the two switched ports to connect to the discharge or drain port.

FIG. 2 shows the logical operation of the valves. In one position port "A" is connected to port "I" while port "B" is connected to port "O". In the other position port "B" is connected to port "I" while port "A" is connected to port "O". In the center position, that is not used in the instant hydraulic system, connections between ports "A", "B", "I" and "O" will be set by the type of spool employed in the valve.

The inventor contacted a number of hydraulic valve manufacturers in an attempt to eliminate the hydraulic hammer problem. The manufacturers were unable to help. The inventor then turned to the spools themselves and noted that they were supplied with sharp edges that made the valve shut-off (or open-up) more or less instantaneously. Some technique to gradually open and/or close the hydraulic pilot and slave valves, thus providing gradual control or throttling of hydraulic flow, was required.

Figure 9:
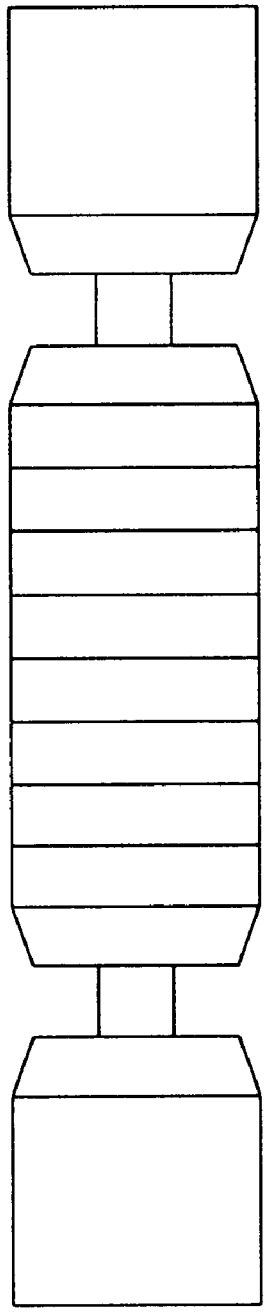
FIG. 9 shows the first series of modifications to the manufacturer's spool (with the slave valve) to reduce hydraulic hammer when shifting. The particular series of modifications shown in this figure were not concerned with the neutral (center) position. The table is the inventor's and illustrate how the unique spool evolved.

The inventor started with the slave valve that was contributing the greatest amount of hydraulic hammer because the majority of hydraulic fluid was controlled by this valve. FIG. 9, shows the first modified spool. The modifications were the addition of "slope" (H°) to the edges of the spool. (Note the original valve had sharp edges.) The slope was cut into the body of the spool. The slope caused slow shut-off or slow cut-on of hydraulic fluid within the slave valve as compared to the sharp right angled edges of the original spool provided by the manufacturer. The figure also shows a table of experimental valves used with a number of spools. However the approach of FIG. 9, still allowed considerable hammer.

Figure 8:
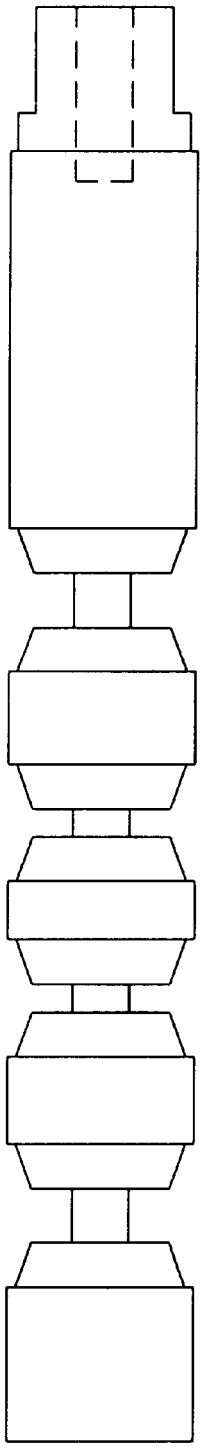
FIG. 8 shows the modifications made to the slave spool to reduce hydraulic hammer whenever the pilot shifts from one position to the other.

Based on his experiments with the spool of FIG. 9, the inventor proceeded to the spool of FIG. 8. In this design each "cut" on the spool, that directs hydraulic fluid within the slave valve, is sloped to approximately 10°. The inventor determined that the slope should lie between 1.5° and 25°. Thus, as Port "A" is switched from "O" to "I" and vice versa, the flow is slowly cut-off. Similarly, as Port "B" is switched from "O" to "I" and vice versa, the flow is slowly cut-off. The "sloped" spool valve of FIG. 8 substantially reduced the hydraulic hammer in the system. However, the problem now moved to the pilot valve.

Figure 7A:
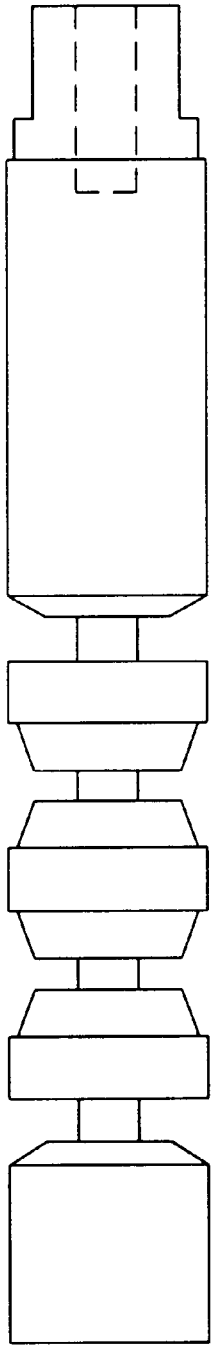
FIG. 7A shows a first modification made to the pilot spool to reduce hydraulic hammer whenever the pilot shifts from one position to the other.
Figure 7B:
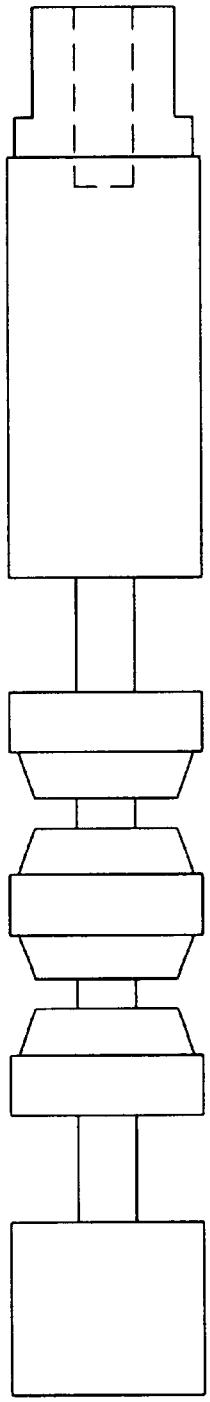
FIG. 7B shows a second modification made to the pilot spool to reduce hydraulic hammer whenever the pilot shifts from one position to the other.

In a similar manner the inventor modified the pilot valve spool as shown in FIGS. 7A and 7B. The slope is again approximately 10°. However, the pilot is somewhat more unique when compared to the slave valve. The pilot is operated by the mechanical position of the control rod and steers the slave valve. Thus, it may be best to rapidly apply pressure to the switched ports and slowly cut-off the pressure. This approach is illustrated in FIG. 7B. FIG. 7A slowly applies or decreases hydraulic flow within the pilot.

The modifications to both valves resulted in a substantial reduction of hydraulic hammer. The equipment now sounds like a muffled 0.22 starting pistol. That is to say the shocking "BANG" no longer occurs; however, there is a noticeable noise whenever the control valves shift position. The sloped-spool valves work and reduce hydraulic hammer, resulting in an overall device that will work reliably.

Embodiment II—Pure Mechanical shift.

Figure 11:
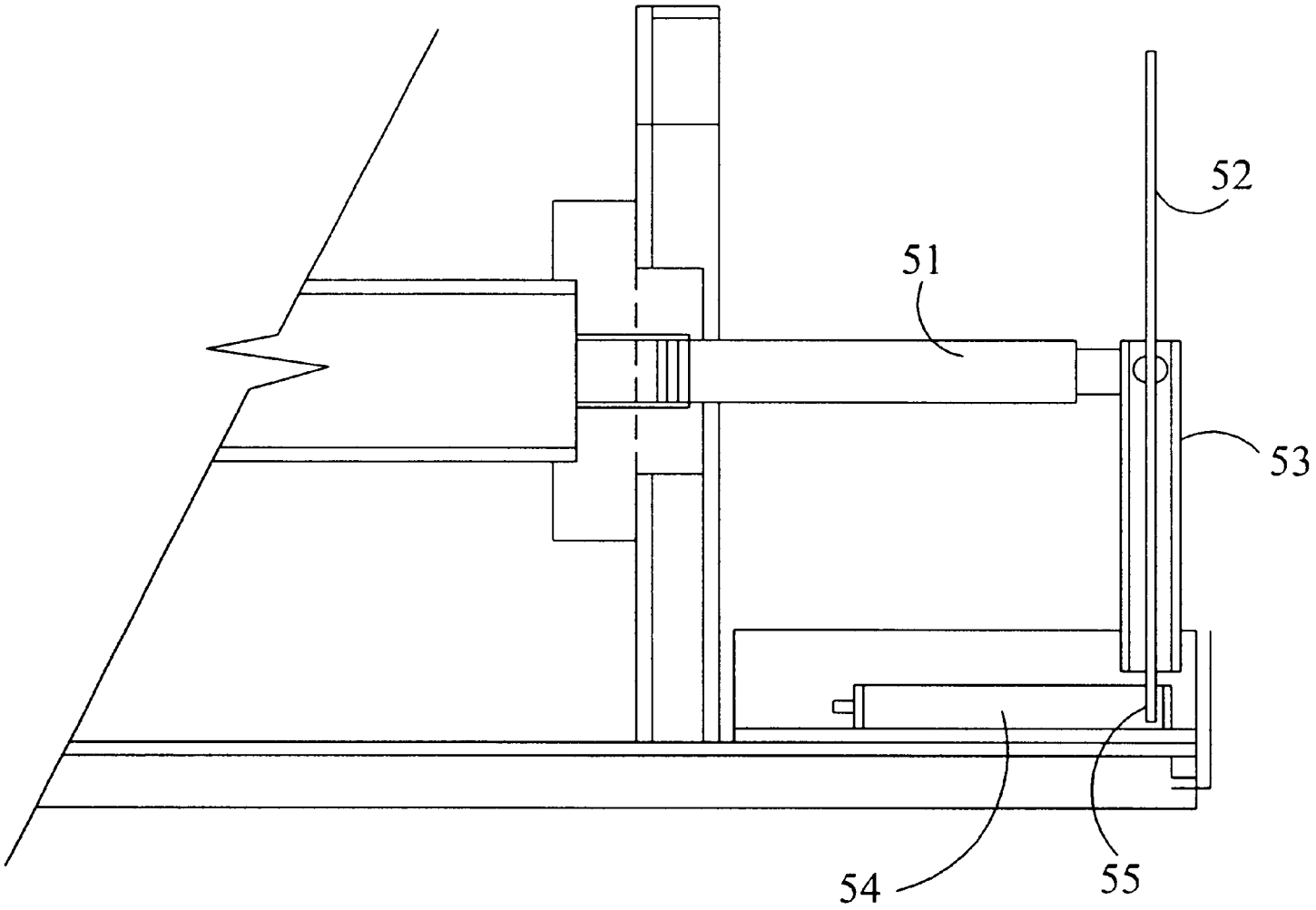
FIG. 11 shows an alternate pure mechanical switching arrangement.

Refer to FIG. 11, as the control rod, 51, nears the end of its stroke, a shifting spring, 52, which pivots in a see-saw fashion off the end of the shifting rod inside of the shifting spring housing, 53, runs into a limit block and a shifting toggle, 55, which is physically attached to a detent and control valve, 54. As the rod continues to travel, the spring is flexed until it develops enough force to overcome the detent resistance and forces a detent ball to move out of its groove. Once the detent is overcome, the flexed spring is released, which flips the mechanisms almost instantly to the opposite locking position in the detent thereby shifting the valve to the other direction. The cylinder then reverses direction until it reaches the other end of the shifting toggle where the shifting process begins in mirror image. Thus the hydraulic cylinder will reciprocate as long as hydraulic oil is being supplied to the unit.

Embodiment III—Electric shift alternate to the preferred embodiment.

Figure 12A:
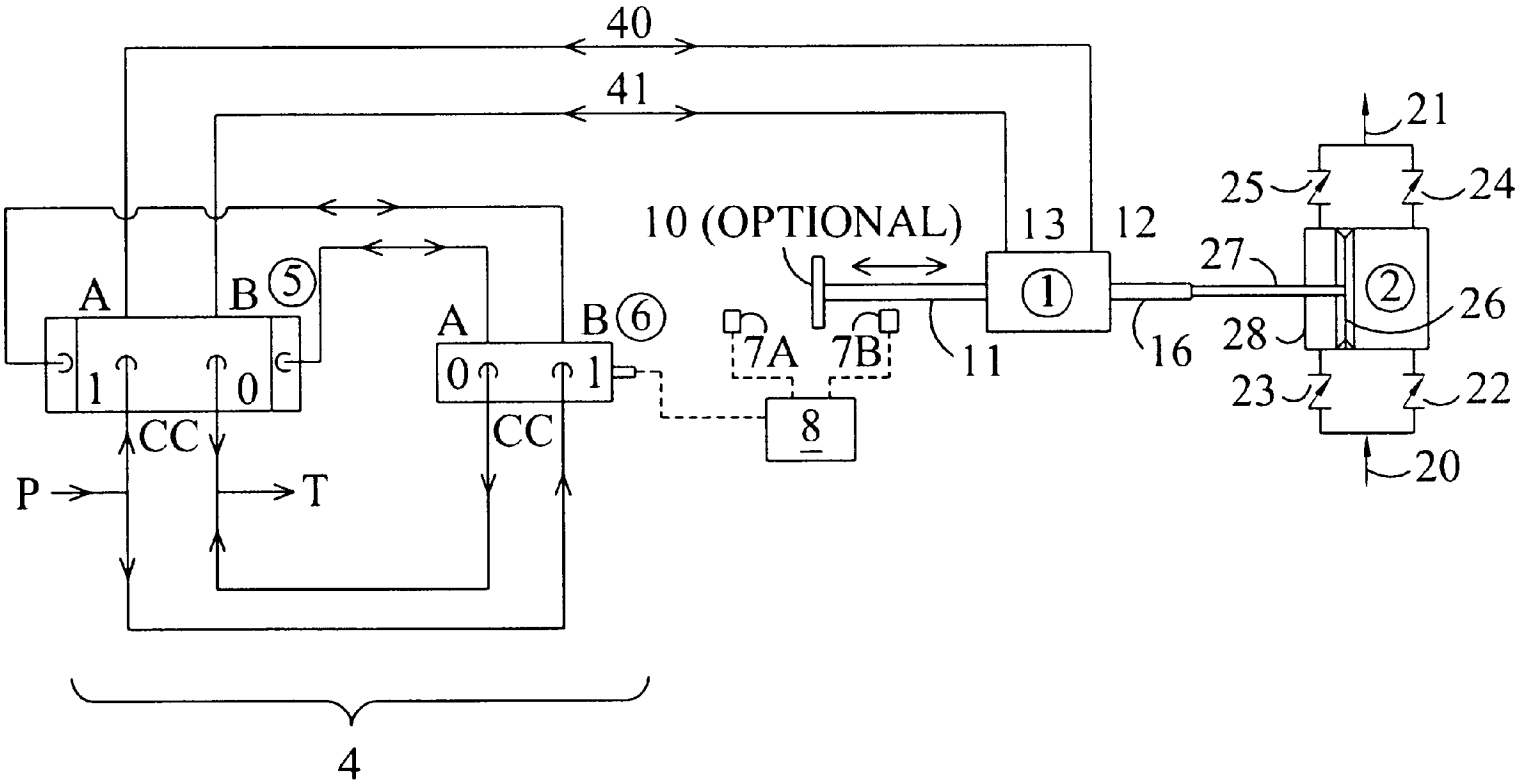
FIG. 12A is a schematic representation of an alternate embodiment of the instant device using proximity switches to sense the motion of the control rod.

Refer to FIG. 12A, as the control rod, 11, approaches the end of its stroke, disk 10 bolted on the end of the control rod passes over a first proximity switch, 7A. Upon activation of the proximity switch, it energizes a solid-state relay 8. The relay energizes a coil on an electric solenoid valve 6, which shifts the hydraulic pilot valve that in turn shifts the slave valve. The cylinder rod now travels in the other direction until the disk passes over a second proximity switch 7B. The proximity switch activates, de-energizing the solid-state relay thereby de-energizing the solenoid valve coil that in turn shifts the pilot valve that in turn shifts the slave valve and the cylinder rod now travels in the opposite direction. Essentially, the mechanical slider arrangement shown in FIG. 2 is replaced by proximity switches driving a pilot valve that results in the same reciprocal action of the hydraulic cylinder cause by the mechanical arrangement of FIG. 2.

Figure 12B:
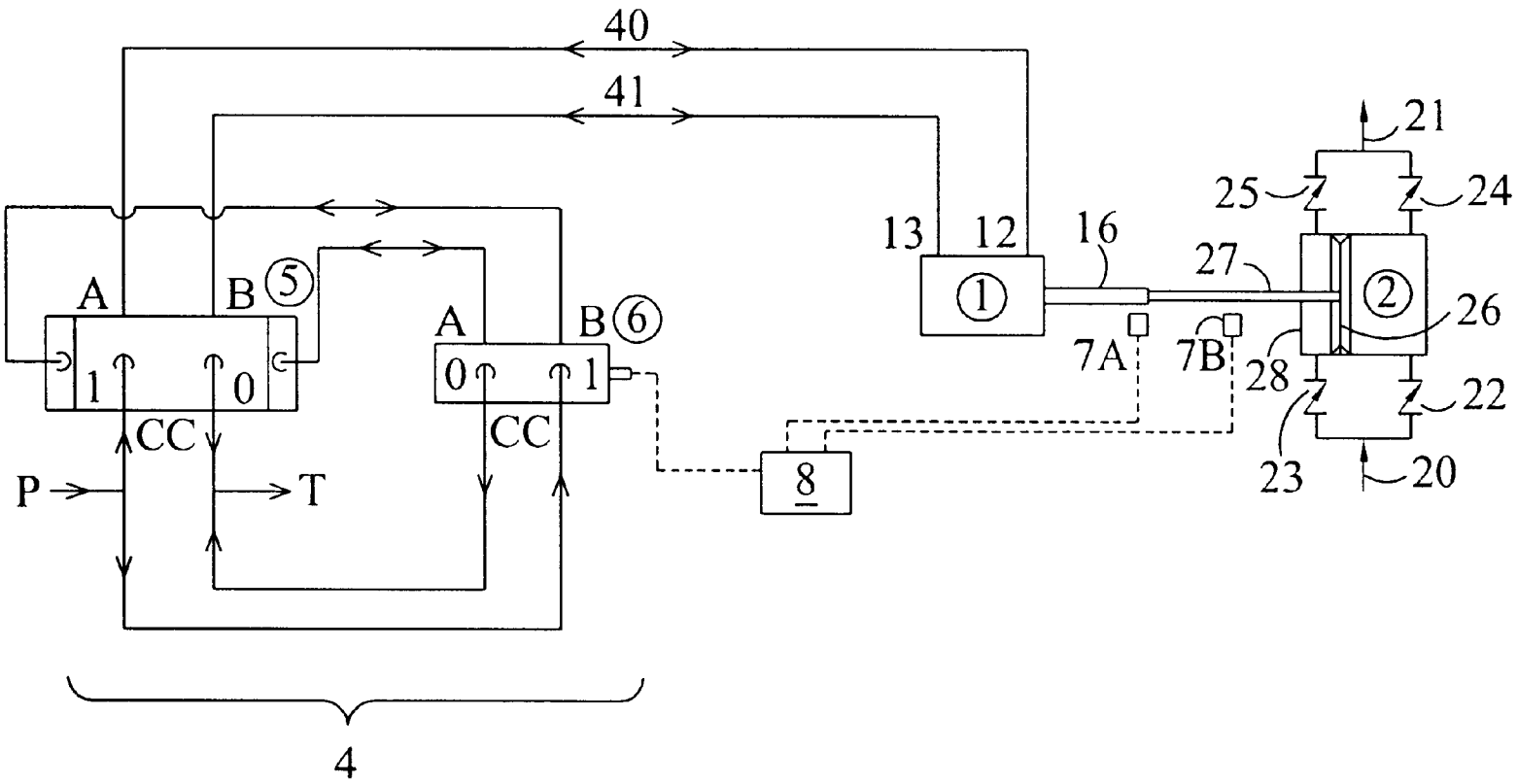
FIG. 12B is a schematic representation of an alternate embodiment of the instant device using proximity switches to sense the motion of the junction between the drive rod and the piston rod where the control rod has been eliminated.
Figure 12C:
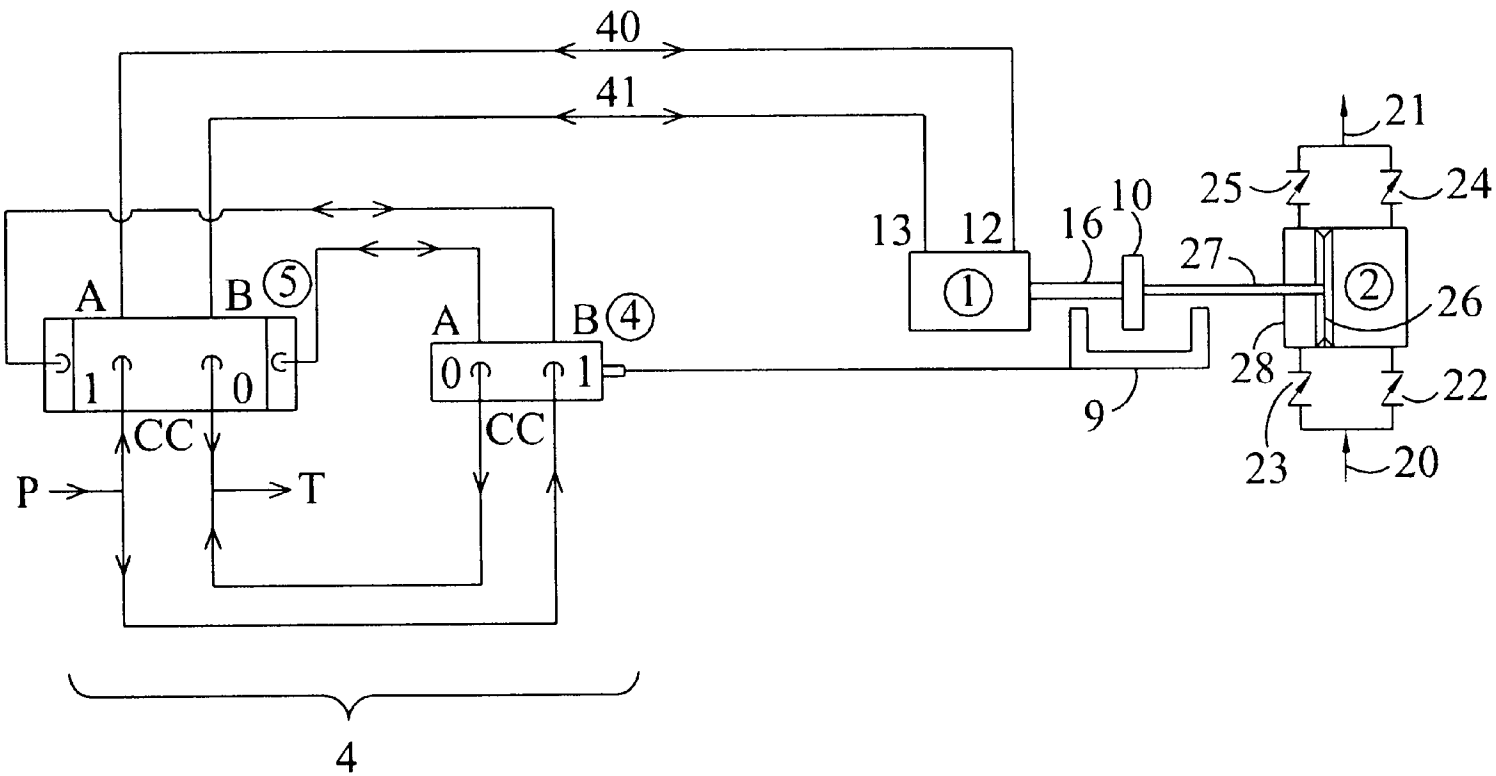
FIG. 12C is a schematic representation of an alternate embodiment of the instant device using a mechanical means to sense the motion of the junction between the drive rod and the piston rod where the control rod has been eliminated.

This technique would best be employed when the control rod is eliminated as shown in FIGS. 12B and 12C. The proximity switches would sense movement of the midpoint of the hydraulic drive rod, 16 and the pump piston rod, 27, and can be placed within the housing joining the hydraulic cylinder to the pump. (See the embodiment that does NOT use a control rod explained in previous paragraphs.)

The concept of "controlled" hydraulic switching is necessary in two alternate embodiments described above. Again, the spools within the valves would have their edges sloped as required.

Because of the design features previously mentioned, the drive system disclosed overcomes the limitations and undesirable characteristics discussed in the background of the invention.

A) Surges and pressure spikes are all but eliminated because of the matched displacement ratios between the hydraulic drive cylinders and the pump cylinders.

B) The drive system when retrofitted to existing pump fluid ends will allow the use of the largest diameter liners (chambers) and pistons thereby maintaining the maximum flow rating of the unit and yet will still be capable of operating at the maximum pressure for which the fluid ends are rated. The original mechanical drive units are not capable of performing this function.

C) The drive units when coupled with a existing pump fluid end will weigh less than one-half to one-third the weight of the pumps when equipped with their original mechanical drives while still being capable of producing four times the work due to the features expounded in (B) above.

D) The units are only about 67% or less the length of hydraulically driven units with pump chambers on each end for a given length of stroke. This makes for a much more practical installation on most machinery.

There has been explained the best and preferred mode for the practice of the instant invention, along with several embodiments. The instant invention relies on the concept of the matching of displacement ratios of the power cylinder to the pump cylinder. The instant invention also discloses a slopped spool valve for use within the hydraulic system to avoid hydraulic hammer caused by the reciprocating hydraulic system.

Control of the reciprocating movement of the power cylinder is considered to fall within the scope of the invention, and three such modes have been described. Other variations for the control of the hydraulic cylinder are considered to fall within the scope of the disclosure. Variations in mechanical positioning of elements is set by the type of hydraulic cylinder employed and the type of piston pump that is to be driven. Such variations are also considered to be within the scope of the disclosure. The concept can readily be extended from mono piston pumps to duplex piston pumps to triplex pumps, etc. This is also considered to fall within the scope of this disclosure.

The inventor has set forth his invention in the appended claims and it is the intent that these claims cover all such changes and modifications set forth in this disclosure.

I claim:

1. A hydraulic drive system utilizing pressured hydraulic fluid for driving a reciprocating piston pump providing smoothed pumped output fluid flow comprising;

a hydraulic drive cylinder incorporating a hydraulic piston having two sides and having a hydraulic piston diameter;

a drive rod having a drive rod diameter connected to one of said sides of said hydraulic piston;

a reciprocating pump having an inlet manifold and an outlet manifold and incorporating a pump piston having two sides and having a pump piston diameter;

a piston rod having a piston rod diameter connected to one of said sides of said pump piston;

means for directing the flow of pressured hydraulic fluid to one side or the other side of said hydraulic piston;

wherein said drive rod is connected to said piston rod whereby when said pressured hydraulic fluid is directed to one side or the other side of said hydraulic piston said hydraulic piston reciprocates in a controlled manner thereby driving said reciprocating pump;

wherein said reciprocating pump has pump a piston displacement ratio related to said pump piston diameter and said piston rod diameter;

wherein said hydraulic drive cylinder has a hydraulic pump piston displacement ratio related to said hydraulic piston diameter and said drive rod diameter;

wherein said hydraulic piston displacement ratio is matched to said pump piston displacement ratio and wherein said matching of said displacement ratios provides a sinusoidal output flow characteristic for said pump.

2. The apparatus of claim 1 wherein said piston displacement ratio is defined as $(1-d^2/D_p^2)$ where d is the diameter of said piston rod and D is the diameter of said pump piston and said hydraulic piston displacement ratio is given by $\{D_h^2-\gamma^2\}/\{D_h^2\}$ where $D_h$ is the diameter of said hydraulic piston and $\gamma$ the diameter of said drive rod and wherein said displacement ratios are set as equal as possible.

3. The apparatus of claim 1 comprising a plurality of hydraulic drives and associated reciprocating pumps wherein said reciprocating pumps share a common inlet and a common outlet manifold.

4. The apparatus of claim 1 wherein said displacement ratios are matched by relating the diameter of said drive rod to the diameter of said piston rod wherein said drive rod diameter is determined by the force that must be applied to said pump piston and said diameter of said piston rod is chosen to match said displacement ratios.

5. The apparatus of claim 1 further comprising two proximity switches for sensing the point at which said drive rod and said piston rod are connected whereby one of said proximity switches is placed near said hydraulic cylinder and said other proximity switch is placed away from said hydraulic cylinder and whereby said proximity switches signal said means for directing the flow of pressured hydraulic fluid whenever said flow should be directed to one side or the other side of said sides of said hydraulic cylinder thereby reciprocating said hydraulic piston at the required time.

6. The apparatus of claim 1 further comprising:

a control rod having a first end and a second end wherein said first end is connected to said other side of said sides of said hydraulic piston and a shifting spring attached to said second end of said control rod for pivotally moving inside a shift spring housing between the ends of a detent and control valve whereby said detent and control valve is hydraulically linked to said means for directing the flow of pressured hydraulic fluid.

7. The apparatus of claim 6 wherein said displacement ratios are matched by relating the diameter of said drive rod and said control rod to the diameter of said piston rod wherein said drive rod diameter is determined by the force that must be applied to said pump piston and said diameter of said control rod is chosen to match said displacement ratios.

8. A hydraulic drive system utilizing pressured hydraulic fluid for driving a reciprocating piston pump providing smoothed pumped output fluid flow comprising;

a hydraulic drive cylinder incorporating a hydraulic piston having two sides and having a hydraulic piston diameter;

a drive rod having a drive rod diameter connected to one of said sides of said hydraulic piston;

a control rod having a control rod diameter connected to other of said sides of said hydraulic piston:

a reciprocating pump having an inlet manifold and an outlet manifold and incorporating a pump piston having two sides and having a pump piston diameter;

a piston rod having a piston rod diameter connected to one of said sides of said pump piston;

means for directing the flow of pressured hydraulic fluid to one side or the other side of said hydraulic piston;

wherein said drive rod is connected to said piston rod whereby when said pressured hydraulic fluid is directed to one side or the other side of said hydraulic piston said hydraulic piston reciprocates in a controlled manner thereby driving said reciprocating pump;

wherein said reciprocating pump has a pump piston displacement ratio related to said pump piston diameter and said piston rod diameter;

wherein said hydraulic drive cylinder has a hydraulic pump piston displacement ratio related to said hydraulic piston diameter, said drive rod diameter, and said control rod diameter;

wherein said hydraulic piston displacement ratio is matched to said pump piston displacement ratio and wherein said matching of said displacement ratios provides a sinusoidal output flow characteristic for said pump.

9. The apparatus of claim 8 wherein said control rod has a first end and a second end said first end being connected to said other side of said sides of said hydraulic piston and further comprising:

a shifting spring attached to said second end of said control rod for pivotally moving inside a shift spring housing between the ends of a detent and control valve whereby said detent and control valve is hydraulically linked to said means for directing the flow of pressured hydraulic fluid.

10. The apparatus of claim 8 wherein said piston displacement ratio is defined as $(1-d^2/D_p^2)$ where d is the diameter of said piston rod and D is the diameter of said pump piston and said hydraulic piston displacement ratio is given by $\{D_h^2-\gamma^2\}/\{D_h^2-\delta^2\}$ where $D_h$ is the diameter of said hydraulic piston, $\gamma$ is the diameter of said drive rod, and $\delta$ is the diameter of said control rod and wherein said displacement ratios are set as equal as possible.

11. The apparatus of claim 8 further comprising a plurality of hydraulic drives and associated reciprocating pumps wherein said reciprocating pumps share a common inlet and common outlet manifold.

12. The apparatus of claim 8 wherein said displacement ratios are matched by relating the diameter of said drive rod and said control rod to the diameter of said piston rod wherein said drive rod diameter is determined by the force that must be applied to said pump piston and said diameter of said control rod is chosen to match said displacement ratios.

13. The apparatus of claim 8 further comprising two proximity switches for sensing the point at which said drive rod and said piston rod are connected whereby one of said proximity switches is placed near said hydraulic cylinder and said other proximity switch is placed away from said hydraulic cylinder and whereby said proximity switches signal said means for directing the flow of pressured hydraulic fluid whenever said flow should be directed to one side or the other side of said sides of said hydraulic cylinder thereby reciprocating said hydraulic piston at the required time.

* * * * *